US008336563B2

(12) United States Patent
Guenther et al.

(10) Patent No.: US 8,336,563 B2
(45) Date of Patent: Dec. 25, 2012

(54) DEVICE FOR APPLICATION OF A COSMETIC POWDER TO A SPONGE

(75) Inventors: Christiane Guenther, Radolfzell (DE); Klaus Lindenau, Radolfzell (DE); Hans Merk, Maerstetten (CH); Thomas Bruder, Constance (DE)

(73) Assignee: Ing. Erich Pfeiffer GmbH, Randolfzell (DE)

( * ) Notice: Subject to any disclaimer, the term of this patent is extended or adjusted under 35 U.S.C. 154(b) by 230 days.

(21) Appl. No.: 12/661,472

(22) Filed: Mar. 18, 2010

(65) Prior Publication Data

US 2010/0236572 A1 Sep. 23, 2010

(30) Foreign Application Priority Data

Mar. 19, 2009 (DE) ..... 10 2009 015 303

(51) Int. Cl.
*A45D 33/02* (2006.01)

(52) U.S. Cl. ..... 132/299; 132/298

(58) Field of Classification Search ..... 132/299, 132/75, 286, 293, 294, 298, 303, 305, 306, 132/307, 314, 317, 320, 318, 313; 220/560.03, 220/501, 521–523, 526, 203.01, 203.07, 220/368, 370–373; 128/203.11, 200.21; 222/71, 189.02, 189.03, 189.06, 189.09, 222/189.11, 416, 460, 462, 480, 548, 546, 222/565; 206/581, 823; 401/123, 196, 202, 401/268, 269, 118, 126; 15/229.14; 221/208, 221/209, 271, 272, 276; 604/68, 141, 190, 604/235

See application file for complete search history.

(56) References Cited

U.S. PATENT DOCUMENTS

| | | | | | |
|---|---|---|---|---|---|
| 1,362,808 | A | * | 12/1920 | McFarland | 401/130 |
| 1,620,002 | A | | 3/1927 | Barany | |
| 1,635,326 | A | | 7/1927 | Kasdan et al. | |
| 1,717,573 | A | * | 6/1929 | McAtee | 220/373 |
| 1,750,215 | A | * | 3/1930 | Dwyer | 206/81 |
| 1,934,809 | A | * | 11/1933 | Maillard | 132/299 |
| 1,999,228 | A | * | 4/1935 | Bauer | 132/299 |
| 2,136,204 | A | * | 11/1938 | Amdur | 401/17 |
| 3,559,840 | A | * | 2/1971 | Wilson et al. | 220/371 |

(Continued)

FOREIGN PATENT DOCUMENTS

DE 10 2006 060 386 7/2008

(Continued)

OTHER PUBLICATIONS

European Patent Office Search Report dated Sep. 6, 2010 (7 pages) with English translation of categories of cited documents.

*Primary Examiner* — Vanitha Elgart
(74) *Attorney, Agent, or Firm* — Flynn, Thiel, Boutell & Tanis, P.C.

(57) ABSTRACT

In accordance with the invention the device has a housing (112, 114), a receiving shell (150) arranged on the housing (112, 114) to accommodate the sponge (192) which can be accessed from outside, a powder reservoir (170) disposed in the housing (112, 114) for storage of the powder (190) before application and a transport device (116, 160, 174, 180) provided in the housing (112, 114), wherein the transport device (116, 160, 174, 180) is formed to transport the powder from the powder reservoir (170) to the receiving shell (150).

17 Claims, 3 Drawing Sheets

U.S. PATENT DOCUMENTS

| | | | | |
|---|---|---|---|---|
| 4,820,276 | A * | 4/1989 | Moreno | 604/190 |
| 4,906,120 | A * | 3/1990 | Sekiguchi et al. | 401/268 |
| 4,930,923 | A * | 6/1990 | Reichmann et al. | 401/278 |
| 4,944,625 | A * | 7/1990 | Futter et al. | 401/153 |
| 4,982,751 | A | 1/1991 | Oishi et al. | |
| 5,082,150 | A * | 1/1992 | Steiner et al. | 222/189.09 |
| 5,810,027 | A * | 9/1998 | Frantzeskakis | 132/320 |
| 5,839,626 | A * | 11/1998 | Gross et al. | 222/494 |
| 5,884,638 | A * | 3/1999 | Ohba | 132/318 |
| 6,053,183 | A * | 4/2000 | Rizzo | 132/307 |
| 6,224,287 | B1 * | 5/2001 | Gieux | 401/282 |
| 6,234,181 | B1 | 5/2001 | Lou | |
| 6,508,256 | B2 * | 1/2003 | Byun | 132/313 |
| 6,659,109 | B2 * | 12/2003 | Noa | 132/317 |
| RE38,398 | E | 1/2004 | Gueret | |
| 6,981,962 | B1 * | 1/2006 | Lenkersdorf | 604/78 |
| 7,101,107 | B1 | 9/2006 | Byun | |
| 8,016,508 | B2 * | 9/2011 | Byun | 401/286 |
| 8,047,214 | B2 * | 11/2011 | Thorpe et al. | 132/299 |
| 8,074,665 | B2 * | 12/2011 | Pires et al. | 132/293 |
| 2003/0024545 | A1 * | 2/2003 | Delage | 132/299 |
| 2003/0056804 | A1 * | 3/2003 | Tajima | 132/320 |
| 2004/0035438 | A1 * | 2/2004 | Hwang et al. | 132/299 |
| 2004/0244813 | A1 * | 12/2004 | Choi | 132/313 |
| 2005/0141951 | A1 * | 6/2005 | Gueret | 401/202 |
| 2005/0188999 | A1 * | 9/2005 | Byun | 132/313 |
| 2005/0199655 | A1 | 9/2005 | Petit | |
| 2006/0201528 | A1 * | 9/2006 | Lee | 132/299 |
| 2006/0207627 | A1 * | 9/2006 | Thorpe et al. | 132/320 |
| 2007/0205233 | A1 | 9/2007 | Petit et al. | |
| 2007/0251542 | A1 * | 11/2007 | Tajima | 132/320 |
| 2008/0149131 | A1 * | 6/2008 | Brendel et al. | 132/299 |
| 2008/0188797 | A1 * | 8/2008 | Enggaard | 604/68 |
| 2008/0223879 | A1 * | 9/2008 | Batinkoff et al. | 222/207 |
| 2008/0276956 | A1 * | 11/2008 | Cho | 132/294 |
| 2009/0205673 | A1 * | 8/2009 | Richardson | 132/307 |
| 2009/0272400 | A1 * | 11/2009 | Park et al. | 132/298 |
| 2010/0000568 | A1 * | 1/2010 | Fraillon | 132/299 |
| 2010/0101600 | A1 * | 4/2010 | Kang | 132/299 |
| 2010/0143023 | A1 * | 6/2010 | Kim | 401/269 |

FOREIGN PATENT DOCUMENTS

| | | | |
|---|---|---|---|
| FR | 2 866 819 | A1 | 9/2005 |
| WO | WO 2008/130166 | A1 | 10/2008 |

* cited by examiner

DEVICE FOR APPLICATION OF A COSMETIC POWDER TO A SPONGE

FIELD OF USE AND CURRENT TECHNOLOGY

The invention relates to a device for application of a cosmetic powder to a sponge. Such a device may be formed such that it comprises a housing, a receiving shell arranged on the housing which accommodates the sponge and is accessible from the outside, a powder reservoir within the housing to store the powder before application and a transport device provided in the housing. The transport device is formed to transport the powder from the powder reservoir to the receiving shell.

It is usual to use a small flat sponge applicator to apply a cosmetic powder to the skin, for instance to apply a matting powder, a rouge powder or a make-up powder. Before applying the powder to the skin the sponge is generally dipped manually into a powder compact and pressed into the powder contained therein. The powder adheres to the sponge and can then be applied to the skin by means of the sponge.

This method used to date may be regarded as disadvantageous since it is difficult to meter the powder and it is also difficult to prevent the hands of the user coming into contact with the powder and being soiled when applying the powder to the sponge. In addition, the pressure applied to the powder present in the powder compact can lead to the formation of clumps in the powder.

A device of the generic type is known from DE 102006060386 A1 in which force is applied to the medium through the generation of a mechanical impact, so that the medium trickle's down on to an applicator. A spender is further known from U.S. Pat. No. 1,635,326 in which a powder reservoir is arranged in an annular manner around a receiving shell. A slit at the bottom of the shell can be opened so that powder can slide into the shell from the reservoir.

AIM OF THE INVENTION AND SOLUTION

The aim of the invention is to provide a method that enables the powder to be applied to the sponge in a simpler and more reproducible manner.

In accordance with the invention this is achieved by a device for application of a cosmetic powder to a sponge, the transport device of which is arranged to generate an air stream, wherein the flow path of the air stream passes by the powder reservoir for the purpose of taking up powder and then enters the receiving shell.

The device according to the invention serves to avoid application of the powder to the sponge by directly guiding the sponge. Instead of bringing the sponge directly into contact with the powder, the sponge is laid in the receiving shell provided on the device. To then provide the sponge in the shell with powder, the device firstly has a powder reservoir within the housing and secondly a transport device which can be actuated so that in response powder is guided from the powder reservoir to the receiving shell and thus to the sponge present therein. The transport device allows a virtually reproducible quantity of powder to be applied to the sponge. Since the powder present in the powder reservoir is not directly subject to mechanical pressure the consistency of the powder remains loose and powdery.

The manner in which the transport device is connected to the receiving shell further enables influence to be exerted in a targeted way on the point at which the powder is applied to the sponge, for instance through the arrangement of inlet channels for the powder in the receiving shell. The receiving shell itself is arranged as a depression which is preferably adapted to the shape of the sponge in such a way that the sponge is forced to assume a largely defined position (+/−15 mm) within the receiving shell. The shell preferably has a circumferential border so that the sponge is laid in the receiving shell from above. The sponge for the purpose of the invention is a body of a foam-like material or a material similar to cotton wool. The sponge may also be a body that is flexible in shape with a defined surface, for instance a latex, velvet or velour surface. Sponges within the meaning of this invention are also referred to in general as pads or powder puffs.

The transport device of the device may be an electrically-operated transport device. It is preferred, however, if it is a manually actuated transport device so that transport of powder to the sponge is achieved through energy applied manually.

The application of powder via an air stream is regarded as expedient since such a transport device is simple to realize and the powder is not compressed in such a process, but instead is deposited on the sponge in a loose consistency. The flow path of the air stream is defined through the corresponding shape of the flow channels and guide surfaces. These are preferably formed and arranged such that the air stream flows into the receiving shell on the side facing away from the open side. This results in application of the powder to the lower side of the sponge so that the sponge can be gripped advantageously by the upper side that is not coated with powder and can then be used for the intended purpose.

It is a particular advantage if the transport device has a pressure chamber of variable volume to apply pressure to the air, with an outlet valve assembly assigned to the pressure chamber. Such a pressure chamber, the volume of which can preferably be changed manually, together with a correspondingly arranged outlet valve assembly, enables generation of an air stream in the direction of the receiving shell only when a minimum pressure has been reached. This is expedient since if the pressure is too low then powder will not be removed from the powder reservoir to the degree required. It is therefore an advantage if the outlet valve assembly is formed such that it only opens if there is a minimum positive pressure in the pressure chamber, preferably from a minimum positive pressure of 0.4 bar. In such a case the outlet valve assembly is arranged such that it remains closed until this positive pressure is reached and only opens when the positive pressure is reached. The minimum positive pressure of 0.4 bar has been found to be advantageous since it reliably leads to the transport of the powder. Of particular advantage is an outlet valve assembly that opens at a positive pressure between 0.5 bar and 0.7 bar. This results in an especially good transport of powder without this positive pressure leading to the undesired ejection of the sponge from the receiving shell.

A described outlet valve assembly can, for instance, have a rigid valve body and a rigid valve seat, wherein the valve body is pressed into the valve seat through the force of a spring which is overcome through the rising pressure in the pressure chamber during its reduction in size. However, it is particularly advantageous in this context if there is an outlet valve assembly with an elastic variable shape outlet valve, which opens through elastic deformation in a pressure-dependent manner. Such elastic variable-shape outlet valves can offer particularly advantageous opening characteristics in which the outlet valve opens fully and almost immediately once the opening pressure has been attained, so that a large percentage of the air under pressure in the pressure chamber flows out of the pressure chamber within a very short period of time and carries the powder to the sponge. With such a valve the rate of volume reduction inside the pressure chamber has little influence.

As an alternative to a pressure-dependent opening valve the outlet valve assembly can also have a valve seat and a valve body, wherein the valve body is pressed through the force of a spring against the valve seat and wherein an ejector is provided that is formed and disposed such that from a pre-determined reduction in the volume of the pressure chamber the valve body is separated from the valve seat. With such an arrangement the pressure in the pressure chamber is not directly responsible for the opening of the outlet valve, but instead the reduction in size of the pressure chamber. In the course of this reduction ejectors provided on a wall of the pressure chamber are moved in the direction of the valve body so that from a pre-determined reduced volume of the pressure chamber the valve body is mechanically lifted off the valve seat and the outlet valve thereby opened. The ejector ensures that the valve is held open so that flow of air out of the pressure chamber does not result in closing of the outlet valve after a short period of time.

It is of particular advantage if the transport device can be actuated through the relative displacement of two parts of the housing, wherein a first housing part forms a base of the device and a second housing part is arranged in a fixed position relative to the receiving shell. With such an arrangement the transport device can be actuated manually by exerting downward pressure on the second upper part of the housing which also contains the receiving shell, whilst the device with the first lower part stands on a fixed base. This allows operation through one hand in a simple manner.

To take up the powder the flow path of the air stream preferably runs through a mixing channel which adjoins the powder reservoir, wherein at least one penetration is provided in one wall of the mixing channel that connects one inner region of the mixing channel with the powder reservoir. When the air flows along the flow path it carries the powder through these penetrations. The mixing channel is preferably aligned vertically so that the powder cannot enter the mixing channel as a result of its weight whilst the device is not in use.

A specially preferred arrangement has a powder reservoir in which the powder is arranged in the powder reservoir because of its weight such that it lies against, at least in part, the outer wall of the mixing channel. This ensures that the powder can be transported by the air stream. If the mixing channel extends vertically then, for example, a base area of the powder reservoir can have the shape of a funnel.

The receiving shell of the device is preferably formed so as to accommodate a flat sponge and for this purpose preferably has a maximum edge height of 15 mm and a base area of at least 30 mm×30 mm. These dimensions enable the holding of the sponges commonly used with cosmetic powders. These sponges have in most cases an approximately quadrangular base area of at least 25 mm×25 mm and a thickness of at least 5 mm. The approximately quadrangular area, however, is preferably at least 30 mm×40 mm. The sponges, however, can also have an elliptical or circular base area, preferably with a diameter of not less than 25 mm, especially more than 35 mm.

In a device according to the invention such a removable flat sponge is therefore preferably arranged within the receiving shell and has a maximum thickness of 15 mm and a base area of at least 20 mm×20 mm.

It is particularly advantageous if the receiving shell is connected to the transport device through a plurality of openings in a base area of the receiving shell, wherein the openings are preferably distributed over at least 25% of the base area of the receiving shell. The use of a plurality of openings particularly facilitates the homogenous distribution of the powder over the area of the sponge intended for this purpose. All of the openings are preferably arranged approximately centrally in the base area of the receiving shell, so that it does not matter in which direction the sponge is laid in the receiving shell. To achieve an approximately uniform discharge of the powder through the different openings, guide surfaces can be arranged in the flow path of the air-powder mixture beneath the openings.

A particular advantage is derived if one opening or the plurality of openings is/are formed/arranged such that they reproduce the shape of one or a number of alphanumeric symbols or a trademark logo. In such a case a homogenous distribution of the powder on the sponge is explicitly not desired. Instead, the powder is applied to the sponge in such a way that it forms lettering or a trademark logo. This in particular serves aesthetic purposes.

In particular with an arrangement with a plurality of openings that connect the transport device to the receiving shell, it is regarded as advantageous if the transport device has a distribution device through which the air stream is split into a number of partial air streams which then flow through the different openings in the receiving shell, with this distribution device preferably having one inlet and one splitting body that is arranged in alignment with the inlet and tapers conically in the direction of the inlet.

In the region of the distribution device the flow path of the air stream widens so that a plurality of openings are supplied with partial air streams. The splitting body can be provided to force the widening of the air stream directly at the inlet of the distribution device. It preferably projects from above in a downward direction in the direction of the inlet and brings about an annular widening of the air stream.

It is of particular advantage if the device has a lid which can be placed on the housing so that the receiving shell can be closed through it. The primary purpose of this lid is to insulate the sponge from its surroundings when the powder is being applied. This prevents the powder from missing the sponge and being spread into the environment. Instead, it remains completely within the receiving shell, especially adhering to the sponge. The lid is thereby preferably arranged relative to the sponge laid in the receiving shell such that with the lid in place it cannot be raised more than 2 mm to 3 mm from the shell base. The sponge is therefore held by the lid in an ideal position to receive the powder. In addition, the lid is also an advantage since it forms an easily graspable upper closing surface to the device which can be pressed downwards for actuation of the transport device. In addition, the lid also serves for concealment of the sponge and the receiving shell when not in use, since the sponge to which powder has been applied and the receiving shell which also has powder on it after frequent use are not deemed to be aesthetically pleasing.

It is of particular advantage if the receiving shell can be removed, with the receiving shell preferably serving to cover the powder reservoir when in position and after removal permitting re-filling of the powder reservoir. The removable arrangement of the receiving shell can be achieved, for instance, by suspending the receiving shell in the housing through lateral extensions. The removal capability allows the receiving shell to be cleaned in a simple manner. In addition, the arrangement of the powder reservoir directly beneath the receiving shell ensures that the powder reservoir can be very easily re-filled.

BRIEF DESCRIPTION OF THE DRAWINGS

Further aspects and advantages of the invention are derived from the claims and also from the following description of two example embodiments of the invention. These are explained through reference to the figures as follows:

DETAILED DESCRIPTION OF THE EXAMPLE EMBODIMENTS

Figure 1:
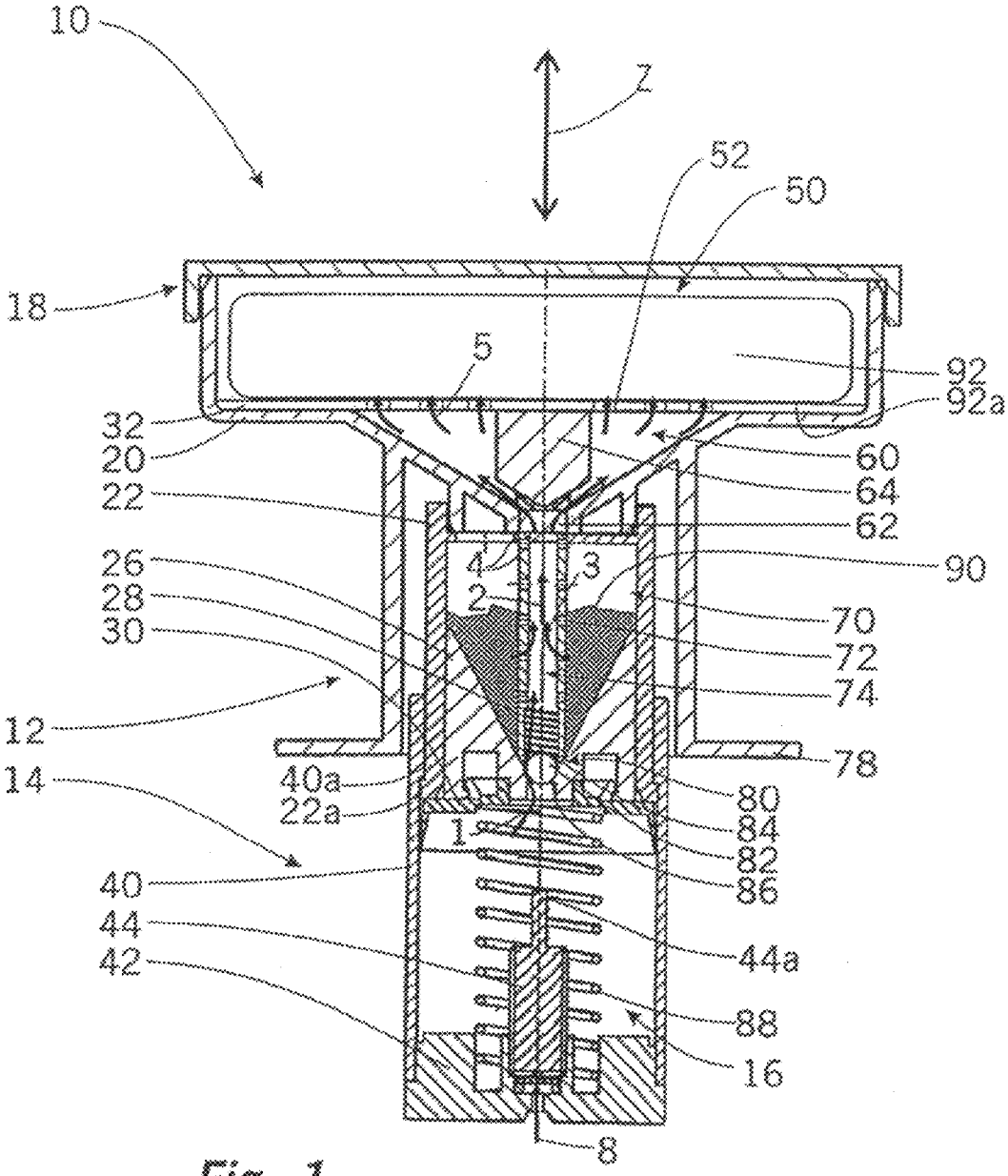
FIG. 1 A first embodiment of a device according to the invention shown in sectional two-dimensional form FIGS. 2*a* and 2*b* Two variants of the embodiment in FIG. 1, in a perspective view FIGS. 3 and 3*a* A second embodiment of the device according to the invention shown in sectional two-dimensional form with a detailed view of a valve fitted therein, and FIG. 4 The embodiment in FIG. 3 in a sectional perspective view.

FIG. 1 shows a first device 10 according to the invention. This has two device parts 12, 14 movable to a limited degree against one another in the direction of a Z-axis. A lid 18 is placed on the upper device part 12.

The two device parts 12, 14 each comprise a plurality of parts fixed in position relative to one another. For the upper device part 12 these are the parts 20, 22, 26, 28, 30 and 32. For the lower device part these are the parts 40, 42 and 44. The aforementioned parts are described in more detail below.

The upper device part 12 has a receiving shell 50 which in the state shown in FIG. 1 is closed through the lid 18 arranged on it and which is accessible from above after removal of the lid 18. The receiving shell 50 is limited to the side through the main part 20 and in a base region through the plate part 32. This plate part 32 has penetrations 52 through which the receiving shell 50 is connected to a distribution device 60 arranged below it.

This distribution device 60 has a substantially funnel shape, wherein the walls of the funnel are also formed by the main part 20. An inlet opening 62 is provided at the lower end of the distribution device 60 and a splitting body 64 is arranged flush with the inlet opening 62 within the distribution device 60. This splitting body 64 can be moulded to the main part 20 through strips, not shown.

A substantially annular powder reservoir 70 is arranged below the distribution device 60 and is limited on its inner side through the tubular part 28 and on its outer side through the hollow cylindrical wall part 22 and the funnel part 26 arranged therein. The tubular part 28 at the same time forms the outer wall of a mixing channel 74 that is enveloped by the powder reservoir 70 and which opens into the distribution device 60. The mixing channel 74 and the powder reservoir 70 are connected through radial openings 72 in the tubular part 28.

A valve 80 is disposed at the lower end of the mixing channel 74 and comprises a conical valve body 82 and a valve spring 84. The valve body 82 is pressed into a valve seat 86 through the spring 84, with the valve seat formed through the lower end of the funnel part 26.

The second device part 14 has a substantially beaker-form shape and is formed through the cylindrical wall part 40 and the base part 42. The ejector part 44 is also provided on this base part 42 and has an ejector mandrel 44*a*.

A radial outwardly-directed connecting edge 22*a* on the wall part 22 and a radial inwardly-directed connecting edge 40*a* on the wall part 40 connect the upper and lower device parts 12, 14 with one another in such a way that they cannot be further apart from each other than as shown in FIG. 1. However, the device parts 12, 14 can be displaced relative to one another in a Z-direction so that against the force of a return spring 88 the volume of a pressure chamber 16 disposed between the device parts 12, 14 can be reduced.

The functioning of the device shown and described is explained below: A powder 90 for cosmetic purposes is provided in the powder reservoir 70 in accordance with the invention. Furthermore, a sponge 92 is arranged in the receiving shell 50 and was placed there in advance and can be removed. To apply a part of the powder 90 to the sponge 92, the device parts 12, 14 are pushed into one another through the manual application of force. This is preferably carried out by the fixed positioning of the lower device part 14 on a stabile base and applying downward pressure on the upper device part 12, under use of finger rests 78. This results in a reduction in the volume of the pressure chamber 16, so that a positive pressure develops in the chamber. This positive pressure reaches its maximum value as soon as the ejector mandrel 44*a* comes into contact with the valve body 82. Application of further downward pressure on the upper device part 12 causes the ejector mandrel 44*a* to press the valve body 82 out of the valve seat 86 so that the pressurized air can flow out of the pressure chamber 16 into the mixing channel 74, as indicated by arrow 1. The air flowing through the mixing channel 74 in the direction of arrow 2 then takes up powder 90 from the powder reservoir 70 through the openings 72, as indicated by arrow 3. The air-powder mixture enters the distribution device 60 and is split by the splitting body 64, as indicated by the arrows 4. The air-powder mixture then passes through the openings 52 along the arrows 5 into the receiving shell 50, where it is deposited on the underside 92*a* of the sponge 92. The sponge 92 then receives a layer of powder on its underside 92*a* which then adheres to the sponge.

Figure 2A:
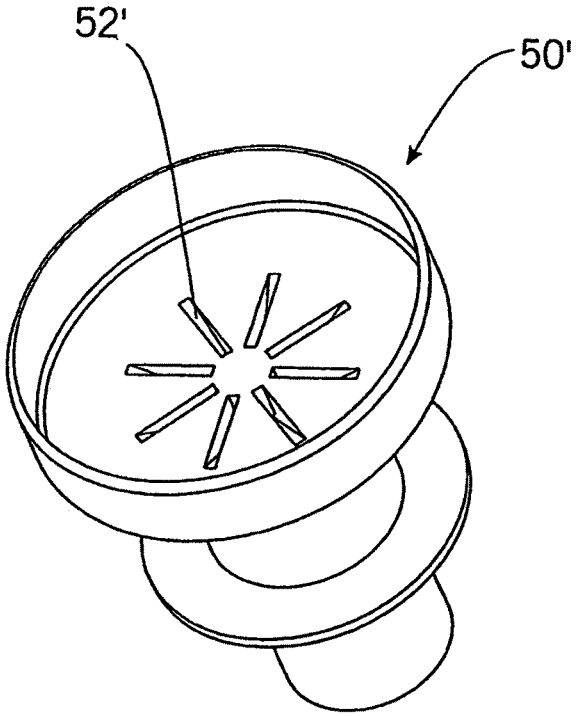
Figure 2B:
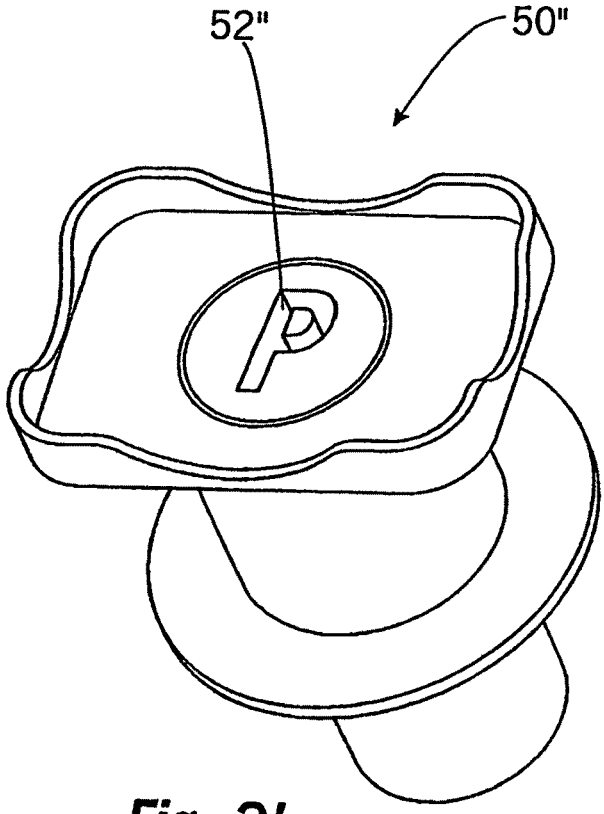

Two variants of the device according to FIG. 1 are shown in perspective views in FIGS. 2*a* and 2*b*. It can be seen from the two variants that the openings 52', 52" can have different shapes. The shape of the openings 52, 52', 52" has the effect that the powder is deposited on the sponge in approximately the corresponding shape. With the variant shown in FIG. 2*a* a total of eight radially-extending openings 52' are provided in a circular receiving shell 50' for a circular sponge. With the variant shown in FIG. 2*b* two overlapping circles are provided as openings 52" in the approximately quadrangular receiving shell 50". The shape of the openings 52" corresponds to that of a trademark logo so that the powder is deposited on the underside of the sponge in the form of this trademark logo.

The application of force by the finger rests 78 is ended after the sponge 92 has been covered with a layer of powder, so that under the action of the return spring 88 the upper device part 12 is lifted back into the starting position shown in FIG. 1. Air then flows again through an inlet valve, not described in detail, of the base part 42 in the direction of the arrow 8 into the pressure chamber 16 that is now increasing in size.

The lid 18 can subsequently be raised to remove the sponge 92 from the receiving shell 50 and to use it in accordance with its purpose.

Figure 3:
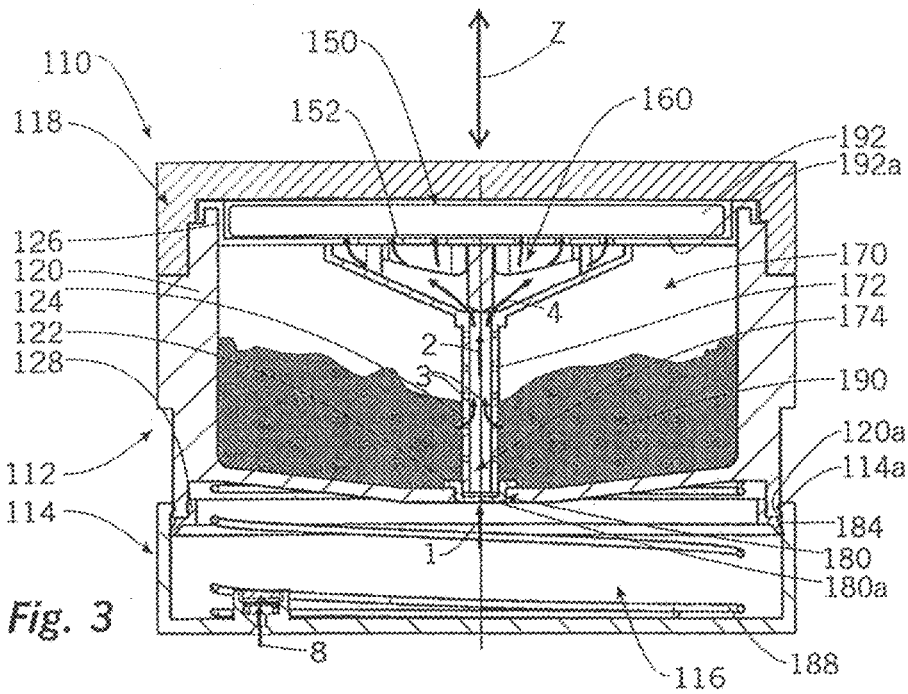
Figure 3A:
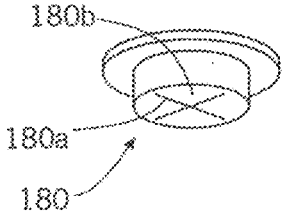
Figure 4:
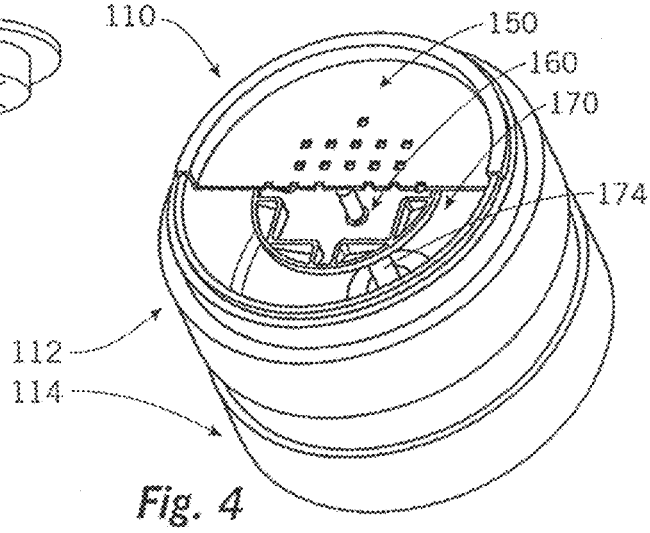

FIGS. 3, 3*a* and FIG. 4 show a second embodiment of the device according to the invention. Although it functions in substantially the same way as that embodiment shown in FIGS. 1 and 2*a*/2*b*, the structure is recognizably different. This second device 110 similarly has an upper device part 112 as well as a lower device part 114. In addition, a lid 118 is provided. The upper device part 112 comprises the parts 120, 122, 124, 126 and 128. The lower device part 114 has a single part 140.

As with the first device 10, the second device 110 has a receiving shell 150 which in this case is formed as a single piece through the shell part 126. This receiving shell 150 again has openings 152 that provide a connection with the funnel-shaped distribution device 160 arranged below the receiving shell 150. This distribution device is substantially formed by the part 124 which at the same time also limits the flow channel 174 adjoining below the distribution device 160 in an outward direction. As with the first embodiment, radial openings 172 are provided in the wall section 124 limiting this flow channel 174 which form a connection to the powder reservoir 170 which envelops the flow channel in an annular manner, which is primarily limited by the outer part 120 and the inner part 124.

A valve 180 is arranged at the lower end of the flow channel 174 and is formed solely by the single part 122. This part 122 is formed from a rubber-like elastic material and has cross-shaped slits 180*a* which enable opening of the valve 180 upon sufficient application of pressure, through the deflection of the four straps 180*b* released through the slits 180*a*. This valve 180 is shown separately and from below in FIG. 3*a*.

A circumferential sealing lip 184 provided by the part 128 which in terms of diameter is matched to an inner wall of the part 140 forms the lower end of the upper device part 112.

A return spring 188 is again arranged within a pressure chamber 116 which is provided between the device parts 112, 114, and forces the device parts 112, 114 apart. A separation of the lower and upper device parts 112, 114 from one another is, however, prevented through the radial inwardly-projecting/outwardly-projecting and interacting edges 114*a*, 120*a*.

The functioning of this second embodiment substantially corresponds to the functioning of the first embodiment. A powder 190 is disposed in the powder reservoir 170. To apply the powder 190 to a sponge 192, this sponge 192 is laid in the receiving shell 150 and the receiving shell 150 then closed through the lid 118.

The upper device part 112 can then be pressed down against the fixed lower device part 114 so that the volume of the pressure chamber 116 is reduced, leading to a rise in pressure in this pressure chamber 116. As soon as the pressure is sufficiently high to open the valve 180, the pressurized air flows along the arrow 1 into the flow channel 174. The air stream there takes up powder in the course of its movement along the arrow 2 through the openings 172, as shown by the arrow 3. The air-powder mixture so formed flows along the arrows 4 into the distribution device 160. From there the air-powder mixture flows through the openings 152 along the arrows 5 into the receiving shell 150 and is deposited on the underside 192*a* of the sponge 192.

As soon as the upper device part 112 is no longer pressed down/held down it moves upwards again as a result of the return force of the return spring 188, with air flowing along arrow 8 into the pressure chamber 116 through a valve assembly that is not described in detail. Once the device 110 has again reached the starting position shown in FIGS. 3 and 4 the lid 118 can be removed and the sponge 192 ready for use can be removed from the receiving shell 150.

The special feature of this second embodiment, aside from its particularly simple external shape, is that the device 110 comprises a particularly small number of simple moulded parts. In addition, the simple shape of the valve 180 enables its comparatively inexpensive manufacture.

A further special feature of this second embodiment is that the receiving shell 150 can be separated from the rest of the device by removal of the shell part 126 that is simply suspended, which firstly enables simple cleaning of the receiving shell 150 and secondly enables easy access to the powder reservoir 170, so that the powder reservoir can be simply re-filled.

The invention claimed is:

1. A device for application of a cosmetic powder to a sponge comprising:

a housing;

a receiving shell to accommodate the sponge, said receiving shell being accessible from outside;

a powder reservoir disposed in the housing for storage of the powder before application; and a transport device;

wherein the transport device is formed to transport the powder from the powder reservoir to the receiving shell, said transport device being designed to generate an air stream, wherein a flow path of said air stream runs along the powder reservoir to take up powder and then enters the receiving shell;

wherein the transport device has a pressure chamber with a variable volume for pressurization of air, wherein an outlet valve assembly is assigned to said pressure chamber; and wherein the outlet valve assembly is formed so that the outlet valve assembly opens at a pre-determined minimum positive pressure in the pressure chamber.

2. The device according to claim 1, wherein the outlet valve assembly has an elastic variable-shape outlet valve which opens through elastic deformation depending on pressure.

3. The device according to claim 1, wherein the outlet valve assembly has a valve seat and a valve body, said valve body being pressed through force of a spring against the valve seat, wherein an ejector is provided that is formed and arranged such that from a pre-determined reduction in a volume of the pressure chamber, the ejector separates the valve body from the valve seat to initiate the air stream.

4. The device according to claim 1, wherein the transport device can be actuated through relative displacement of two housing parts, wherein a first housing part forms a base of the device and a second housing part is arranged in a fixed position relative to the receiving shell.

5. A device for application of a cosmetic powder to a sponge comprising:

a housing;

a receiving shell to accommodate the sponge, said receiving shell being accessible from outside;

a powder reservoir disposed in the housing for storage of the powder before application; and a transport device;

wherein the transport device is formed to transport the powder from the powder reservoir to the receiving shell, said transport device being designed to generate an air stream, wherein a flow path of said air stream runs along the powder reservoir to take up powder and then enters the receiving shell; and wherein the flow path of the air stream runs through a mixing channel which lies next to the powder reservoir, wherein at least one opening is provided in a wall of the mixing channel, said at least one opening connecting an inner region of the mixing channel to the powder reservoir.

6. The device according to claim 5, wherein the powder reservoir is formed such that the powder is arranged in the powder reservoir because of a weight of the powder such that the powder lies at least in part against an outer wall of the mixing channel.

7. The device according to claim 1, wherein the receiving shell is formed to accommodate a flat sponge.

8. The device according to claim 1, wherein the receiving shell is connected through a plurality of openings in a base area of the receiving shell to the transport device.

9. The device according to claim 8, wherein the plurality of openings are formed such that the plurality of openings reproduce a shape of at least one alphanumeric symbol or trademark logo.

10. A device for application of a cosmetic powder to a sponge comprising:

a housing;

a receiving shell to accommodate the sponge, said receiving shell being accessible from outside;

a powder reservoir disposed in the housing for storage of the powder before application; and a transport device;

wherein the transport device is formed to transport the powder from the powder reservoir to the receiving shell, said transport device being designed to generate an air stream, wherein a flow path of said air stream runs along the powder reservoir to take up powder and then enters the receiving shell;

wherein the receiving shell is connected through a plurality of openings in a base area of the receiving shell to the transport device;

wherein the transport device has a distribution device through which the air stream is split into a plurality of partial air streams which pass through different openings in the receiving shell; and wherein the distribution device has an inlet and a splitting body that is arranged in alignment with said inlet and which tapers conically in a direction of said inlet.

11. The device according to claim 1, wherein a lid is provided which can be placed on the housing such that the receiving shell can be closed by the lid.

12. The device according to claim 1, wherein the receiving shell is formed so that the receiving shell is removable.

13. The device according to claim 1, wherein the minimum positive pressure is 0.4 bar.

14. The device according to claim 7, wherein said receiving shell has a maximum height of 15 mm and a minimum base area of 30 mm×30 mm and wherein a removable flat sponge is disposed in the receiving shell and has a maximum thickness of 15 mm and a minimum base area of 20 mm×20 mm.

15. The device according to claim 8, wherein the openings are distributed over at least 25% of the base area of the receiving shell.

16. The device according to claim 10, wherein the openings are distributed over at least 25% of the base area of the receiving shell.

17. The device according to claim 12, wherein the receiving shell, when in an inserted position, serves as a cover for the powder reservoir and after removal permits refilling of the powder reservoir.

* * * * *